US006192649B1

(12) United States Patent
Karim-Panahi et al.

(10) Patent No.: US 6,192,649 B1
(45) Date of Patent: Feb. 27, 2001

(54) ELASTOMERIC SEISMIC ISOLATION OF STRUCTURES AND COMPONENTS

(75) Inventors: Khosrow Karim-Panahi, Palo Alto; James H. Terhune, San Jose; Charles W. Dillmann, Morgan Hill, all of CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 08/440,458

(22) Filed: May 12, 1995

(51) Int. Cl.[7] ..... E04H 9/02; E02D 27/34

(52) U.S. Cl. ..... 52/741.15; 52/167.7; 52/169.9

(58) Field of Search ..... 52/167.1, 167.2, 52/167.4, 167.7, 167.8, 169.9, 741.15, 745.05, 745.13

(56) References Cited

U.S. PATENT DOCUMENTS

| | | | | |
|---|---|---|---|---|
| 4,499,694 | * | 2/1985 | Buckle et al. | 52/167.7 |
| 4,593,502 | * | 6/1986 | Buckle | 52/167.7 |
| 4,651,481 | * | 3/1987 | Csak | 52/167.8 |
| 4,830,927 | * | 5/1989 | Fukahori et al. | 52/167.7 X |
| 4,899,323 | * | 2/1990 | Fukahori et al. | 52/167.7 X |
| 5,201,155 | * | 4/1993 | Shimoda et al. | 52/167.7 |

FOREIGN PATENT DOCUMENTS

| | | | | |
|---|---|---|---|---|
| 2628276 | * | 1/1977 | (DE) | 52/167.7 |
| 278641 | * | 11/1989 | (JP) | 52/167.4 |
| 3814226 | * | 11/1989 | (DE) | 52/167.4 |
| 402049834 | * | 2/1990 | (JP) | 52/167.7 |
| 402217633 | * | 8/1990 | (JP) | 52/167.7 |
| 675137 | * | 7/1979 | (SU) | 52/167.4 |

* cited by examiner

*Primary Examiner*—Michael Safavi
(74) *Attorney, Agent, or Firm*—Nixon & Vanderhye P.C.

(57) ABSTRACT

A clamped support system for a structure comprising a plurality of support piers in a predetermined array, supporting the structure; and at least two rigid reinforcing pads sandwiched about an elastomer layer, the plurality of support piers extending through the reinforcing pads and the elastomer layer.

13 Claims, 7 Drawing Sheets

ELASTOMERIC SEISMIC ISOLATION OF STRUCTURES AND COMPONENTS

TECHNICAL FIELD

This invention relates to a method and structure for mitigation of seismic forces on nuclear power plants, other structures and components, utilizing specially designed elastomers to dissipate the seismic energy.

BACKGROUND

Seismic events create reaction forces in massive bodies and structures that can destroy them, if the seismic energy is not adequately dissipated. It is common practice, and well known in the art of seismic design, to "tune" the structure such that its response to the major portion of the seismic spectrum is minimal. This can be done in a number of ways, such as adding dampers, springs, etc. to the base of the structure in a complicated and expensive array of shock absorbing mechanisms. In addition, the structure design itself is usually made either more rigid, or more flexible, so that its response can avoid the spectral peaks of seismic shock waves. These measures are more or less effective and limited by the frequency "bandwidth", or response, of the overall design.

DISCLOSURE OF THE INVENTION

With the advent of engineered elastomeric materials, it is now possible to specify means of mitigating seismic response by properly and uniquely applying such materials with frequency-dependent internal damping as a part of the structural design. Thus, energy can be dissipated in the elastomer(s) as the structure attempts to vibrate in response to seismic excitation at a given frequency. In the process, the elastomer experiences a temperature rise, depending on the power density of dissipation internal to the material, and depending on whatever means are provided to dissipate such heat generation. Increasing temperature usually modifies the material properties, so an important aspect of the method here is temperature control by design. This invention specifically addresses both the frequency and the thermal requirements of seismic mitigation as critical parameters in the selection of elastomers for use in damped support structures.

A detailed analysis of this method has been performed to elucidate the trade-offs inherent in it. Using the material properties of elastomers and the time history of typical seismic events, it can be shown that a properly designed base structure provides effective isolation from excessive and destructive seismic forces. It is found that simple structures possess a characteristic frequency (or several frequencies for complicated structures with internal degrees of freedom) that is a function of the structure and elastomer parameters. This frequency is a key factor in designing the system for maximum effectiveness. In addition, the elastomer can be shown to have physical properties that are mathematically similar to electronic filters, thereby filtering the seismic power spectral density in a complicated way that is not obvious to even the most sophisticated practitioners of the art. This is especially true when thermal effects are also considered. The mathematical properties of the system "transfer function" constitute another key factor in the system design and effectiveness.

It so happens that the character of the system response can be described in terms of acceleration, displacement (relative or absolute) or velocity. It is preferred to use net acceleration as the measure of effectiveness. Analysis of the many variables and their inter-relations as described in detail further below, leads to the stated means of mitigating seismic acceleration in structures.

In accordance with an exemplary embodiment of the invention, a damped support structure utilizes one or more layers of an elastomer alternating with reinforced concrete pads. Where multiple elastomer layers are used, the properties of each layer are preferably different, depending on the seismic spectral complexities expected to be encountered. In some cases, several additional layers may be required to obtain the necessary spectral response, and these variants are included within the spirit and scope of this invention. In a two layer elastomer arrangement (again, alternating with concrete reinforcing pads), because of the mass of the upper concrete reinforcing pads, the characteristic frequency is smaller for the lower elastomer pad than for the upper elastomer pad. In addition, the elastomer pads are coupled, and the support structure has multiple degrees of freedom that can be analyzed in accordance with the discussion hereinbelow. The damping factors for the elastomers can be specified by analysis to adequately restrain the motion of the superstructure or building that is to be protected. Clearly, the size and construction of the support structure depends on the properties of the building that is to be isolated from the ground motion, as well as on the anticipated seismic spectrum.

The above described concrete reinforcing pads and elastomer pads are utilized in combination with a plurality of piers or other support members which not only bear a portion of the vertical loads, but also provide some structural rigidity in shear. The piers or support members are also utilized as a major heat transfer path to the bedrock or heat sink. The number, size and placement of the support members are a matter of design, specified by the application. The number and dimensions of the supporting pads are also application specific and dictated by the design. The entire structure is a dynamic system with multiple degrees of freedom, which must be designed to specific criteria. All such designs are included in this disclosure as obvious variants of the basic principles of the invention.

In one aspect of the invention, therefore, there is provided a method of mitigating seismic forces on a structure during a seismic event comprising the steps of:

a) providing a damped support system for the structure comprising a plurality of support piers surrounded by at least two layers of reinforced concrete on either side of at least one layer of an elastomer where the elastomer is formed to include thermal diffusion and damping properties determined as a function of properties of the structure and as a function of an expected seismic event frequency spectrum; and b) dissipating heat generated in the elastomer during the seismic event.

In another aspect of the invention, there is provided a method of mitigating seismic forces on a structure during a seismic event comprising the steps of:

a) supporting the structure with a plurality of piers; and b) surrounding the plurality of piers with a seismic damping system including at least one elastomer engineered to include damping properties specified as a function of a predicted seismic frequency spectrum.

In still another aspect, the invention relates to a dumped support system for a structure comprising a plurality of support piers in a predetermined array, supporting the structure; and at least two rigid reinforcing pads sandwiched about an elastomer layer, the plurality of support piers extending through the reinforcing pads and the elastomer layer.

The invention here, as it relates to a methodology and resultant elastomeric isolation structure, provides the following advantages:

1) It provides means of minimizing seismic response of structures and components without the necessity of expensive and cumbersome mechanical springs, dampers, snubbers, etc.;
2) It utilizes internal damping inherent to elastomeric solids to absorb seismically induced energy in structures and components without damaging the elastomer;
3) It provides means of "tuning" the system by judiciously choosing the various parameters and dimensions, thereby enhancing the internal dissipation of energy in the frequency range containing the most excitation of energy;
4) It utilizes a unique "sandwich" configuration that is specific to the minimization of seismic response and conducive to stable structural design;
5) It provides a means of essentially eliminating undesirable frequencies in the excitation spectrum that could otherwise result in undesirable resonance excitation of structures and components; and
6) Elastomeric isolation designs can be retrofitted into existing nuclear plant components if necessary to limit piping motion, control room accelerations, and a variety of equipment responses.

Additional objects and advantages of the subject invention will become apparent from the detailed description which follows.

BEST MODE FOR CARRYING OUT THE INVENTION

Figure 1:
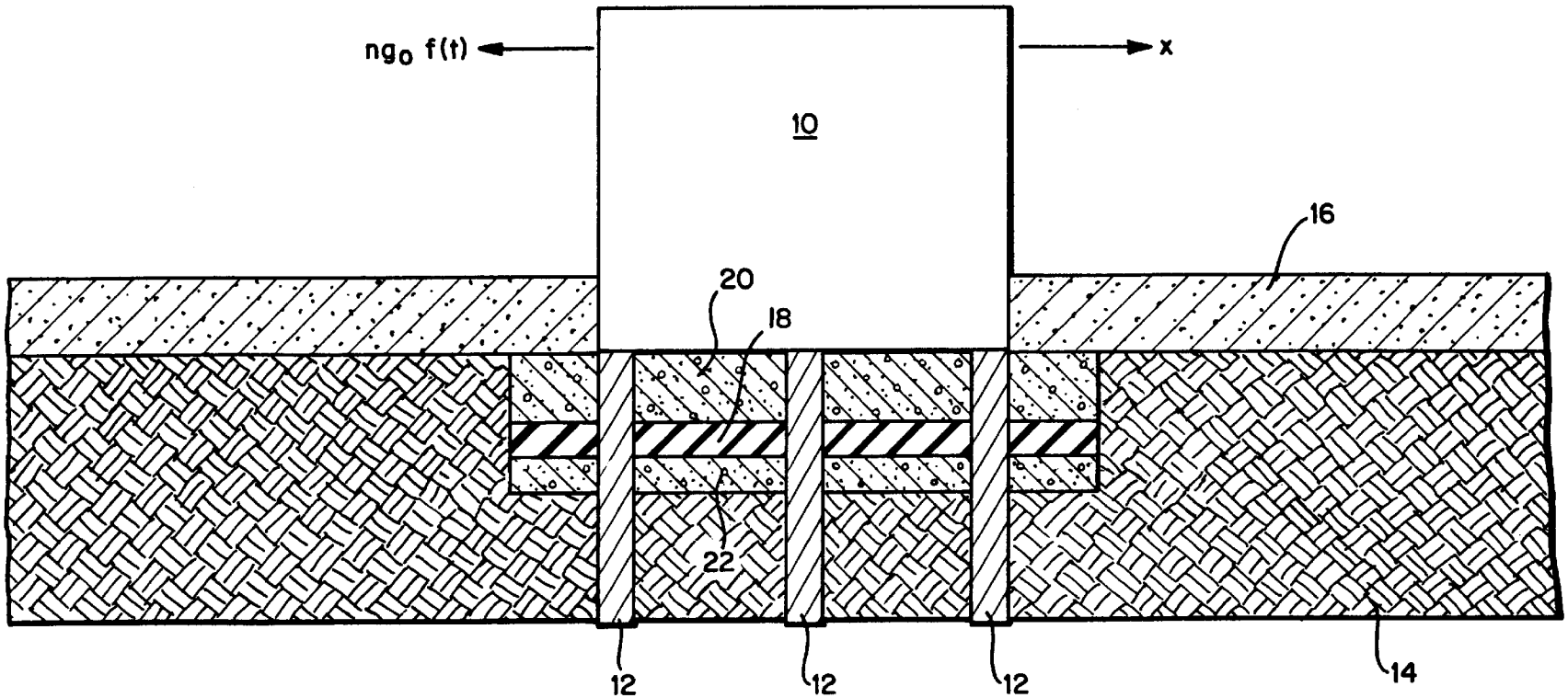
FIG. 1 is a seismic isolation schematic illustrating a simplified embodiment of the invention and useful in the mathematical analysis aspect of the invention.

Referring to FIG. 1, a structure 10 (for example, any kind of building which is desired to be protected to the extent possible during a seismic event) is supported directly by a plurality of piers 12, the latter anchored in bedrock 14 located below grade level material 16. An elastomer layer or pad 18 (which can include one or more such layers) is located between a pair of concrete reinforcing pads or decks 20 and 22. The piers 12 extend through the reinforcing pads 20, 22 and elastomer pad 18 as shown in the Figure. Utilizing the structure of FIG. 1 as a reference and in order to better understand the invention, the main points of the complicated and lengthy analysis which led to the method and elastomeric isolation structure in accordance with the invention will be summarized.

Figure 2:
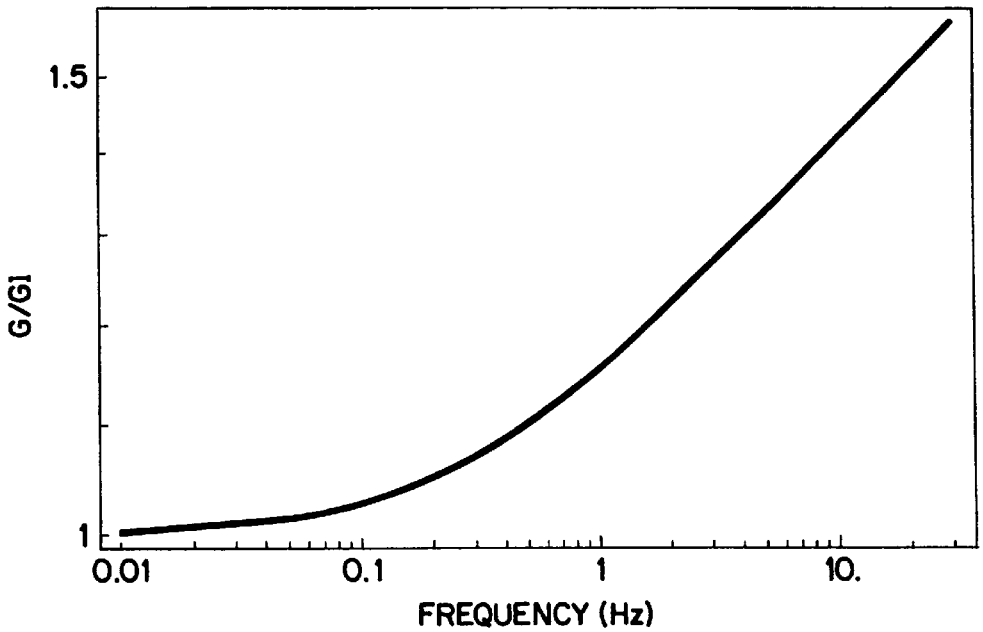
FIG. 2 is a graph illustrating the frequency dependence of elastomer properties such as shear modulus.

A mathematical model of the system depicted in FIG. 1 allows the equation of motion to be written in the form:

$$[-\omega^2 + (\omega_o^2(1 + k_1\omega))^p(1 + i\eta)]\hat{x}(\omega) = (ng_o)\int_0 f(t)e^{i\omega t}\,dt$$

where the Fourier transform of the structural relative displacement is:

$$\hat{x}(\omega) = \int_0^\infty x(t)e^{i\omega t}\,dt$$

and:

$$\omega_o^2 = \frac{G_0 A_s}{ML};$$

$$ng_o = \frac{F_o}{M}$$

$$G(\omega) = G_0(1 + k_1\omega)^p(1 + i\eta)$$

and:

where M is the total mass, $A_s$ and L the elastomer surface area and thickness, $F_0$ the amplitude of the excitation force and $\omega_o$ the characteristic frequency of the system. The normalized acceleration time history is denoted by f(t). G($\omega$) is the elastomer horizontal shear modulus (the primary damping property), whose imaginary part, $\eta$, accounts for internal dissipation. Its real part is an exponentially increasing function of frequency over the range of frequencies contained in the seismic spectrum. This frequency dependence is characterized by the parameters $G_0$, $k_1$, and p, which are engineered material properties of the elastomer. A typical case is shown in FIG. 2 which shows frequency as a function of shear modulus G/G1 of the elastomer. Thus, by specifying horizontal shear modulus in terms of the frequency dependence of its real and imaginary parts, an elastomer manufacturer can provide a custom made elastomer as appropriate for the application at hand (giving due consideration to the additional factors discussed below).

The solution of the equation of motion consists of a transient free motion superimposed with a sustained forced motion. The resulting acceleration is:

$$M[\ddot{x}(t) + \ddot{x}_s(t)] = F_o\left[\frac{\ddot{x}(t)}{ng_o} - f(t)\right]$$

where the quantity in brackets on the right-hand side is:

$$\frac{\ddot{x}(t)}{ng_o} - f(t) = -\frac{1}{ng_o}\{\Omega_+^2 Ae^{i\Omega_+ t} + \Omega_-^2 Be^{-i\Omega_- t}\} -$$

-continued $$\frac{1}{2\pi}\int_0^\infty \frac{\omega^2 g(\omega)}{\omega_o^2[\xi(\omega)+i\zeta(\omega)]}e^{-i\omega t}\,d\omega - f(t)$$

frequencies denoted by $\Omega_\pm$ are roots of the characteristic equation:

$$-\Omega^2 + (\omega_o^2(1+k_1\Omega))^p(1+i\eta) = 0$$

and we define the following functions for convenience:

$$\xi(\omega) = (1+k_1\omega)^p - \frac{\omega^2}{\omega_o^2};$$

$$\zeta(\omega) = (\eta(1+k_1\omega))^p$$

The initial conditions on x(t) describe the structure at rest:

$$x(0)=\dot{x}(0)=0$$

Figure 3:
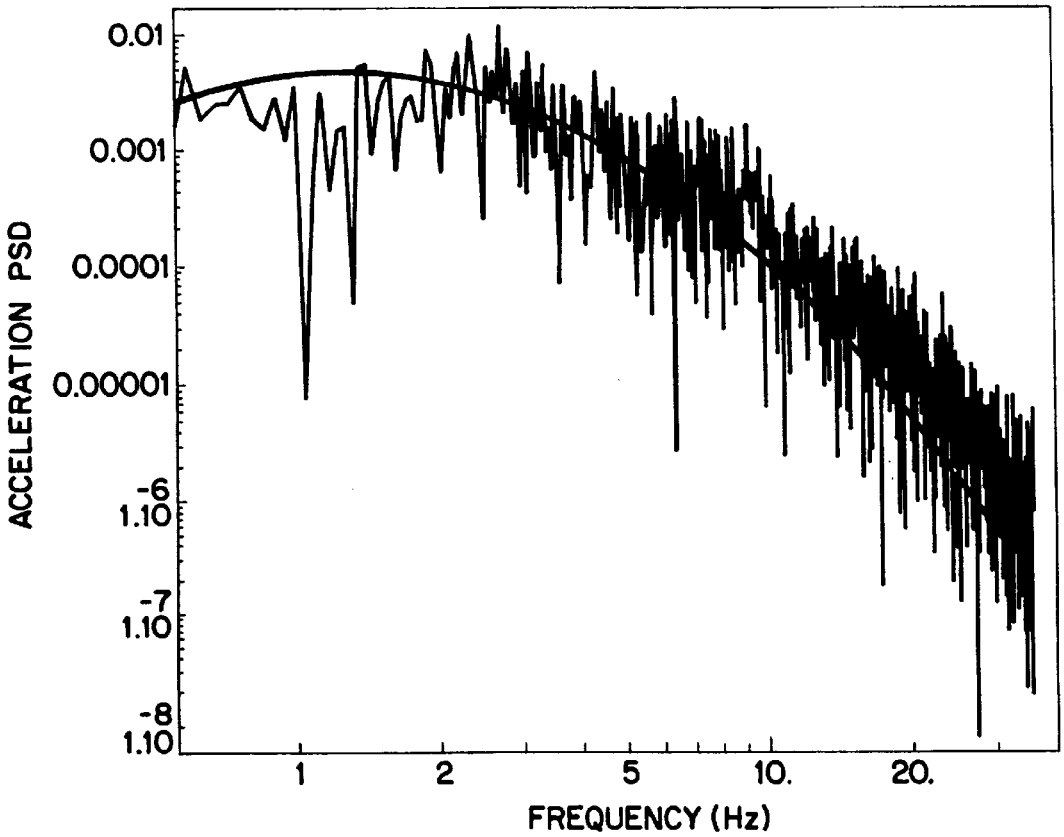
FIG. 3 is a graph illustrating power spectral density versus structural base excitation.

The solution for the structure motion is seen to involve complex variables descriptive of the amplitude and phase of the response, relative to the onset of the seismic time history. For simplicity, only a single horizontal displacement is assumed, but other axes of excitation can be treated in a similar manner. The horizontal power spectral density (PSD) typical of structural base excitation is shown in FIG. 3. The solid curve is an analytic approximation to the mean of the PSD.

Figure 4:
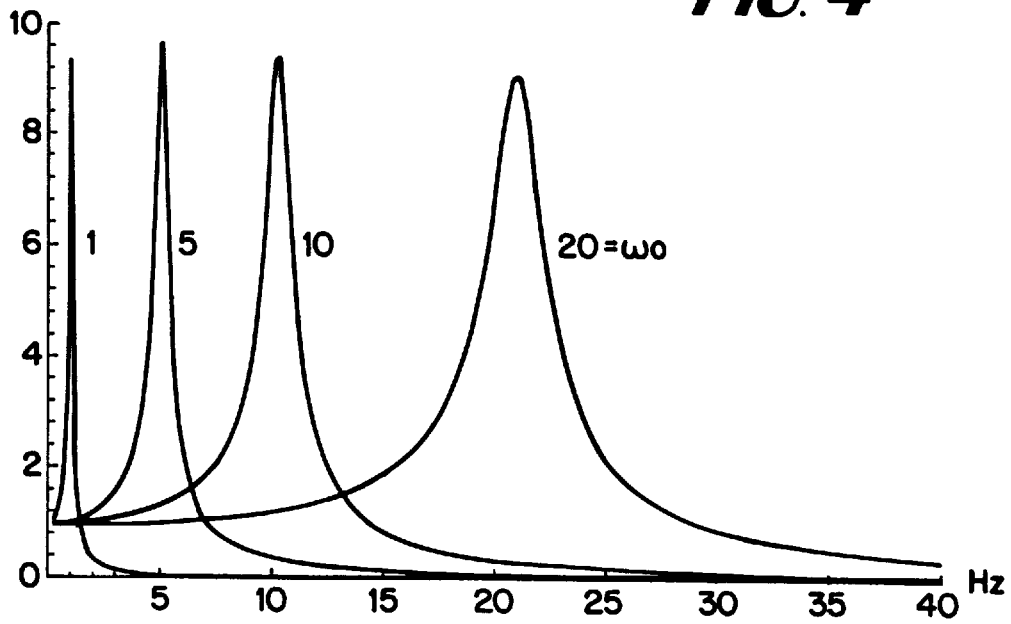
FIG. 4 is illustrates the system transfer function's frequency dependence and showing how the position of the frequency response shifts as $\omega_o$ (the characteristic frequency of the system) is varied.

Note that the excitation energy falls off very rapidly above frequencies around 20 Hz and below 0.5 Hz (off-scale in FIG. 3). However, the excitation contains all frequencies in this range and is continuously distributed. The nature of this excitation is a key factor in the specification of the elastomer/structure system properties. This can be better understood by examining the system transfer function's frequency dependence, shown in FIG. 4 for the case of small damping ($\eta$=0.1). This graph shows how the position of the frequency response shifts as $\omega_o$ is varied. The best option is $\omega_o$=1, given the excitation of FIG. 3. This is a means of specifying some of the elastomer properties.

Figure 5:
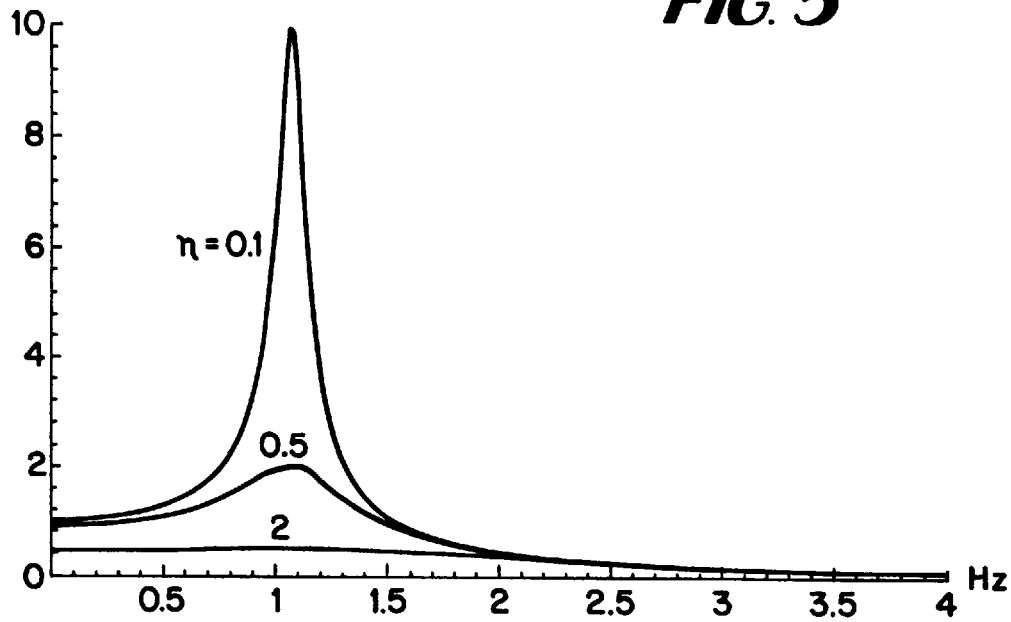
FIG. 5 illustrates how the amplitude of the response varies with damping factor $\eta$, when $\omega_o$=1.

Another requirement on the material properties can be inferred from FIG. 5, which shows how the amplitude of the response varies with damping factor, $\eta$, with $\omega_o$=1. Clearly, responses improve as $\eta$ increases. For the case where $\eta$=2, a greatly diminished amplitude and a limited frequency range are shown, both of which are desirable characteristics. Practically, this is about the maximum value for $\eta$ currently achievable for elastomer materials.

Figure 6:
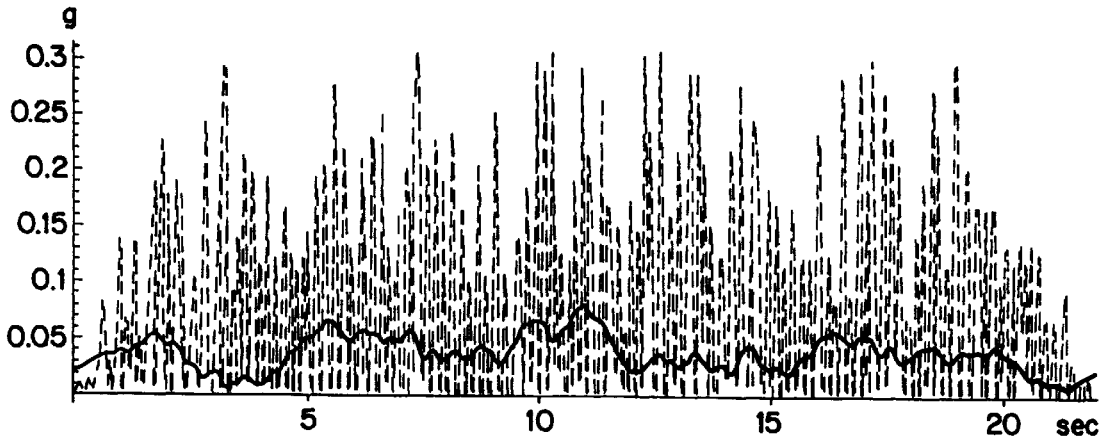
FIG. 6 illustrates the effect in the time domain of material damping on the body force for a particular case.

The effect in the time domain of material damping in accordance with this invention on the body force is illustrated for a special case in FIG. 6. The peak response is below 0.1 g (the solid line in the Figure), whereas the peak excitation exceeds 0.3 g (the jagged peaks in the Figure). The dramatic results in peak response reduction are achieved with the elastomer/reinforcing pad configuration of FIG. 1 which does not require external dampers, snubbers, etc. that are cumbersome and expensive, and typical of prior art arrangements.

Reduction of acceleration requires energy dissipation, given by:

$$E_{elas} + iE_{diss} = \frac{ng_oA_sG_0}{2L\omega_o^2}\int_0^T\left[f(t) - \frac{1}{ng_o}\ddot{x}(t)\right]\dot{x}(t)\,dt$$

where $E_{elas}$ is the portion of the energy in the elastomer that is recoverable, and $E_{diss}$ is the portion that is dissipated as heat. The time-derivative of the imaginary part of the energy, divided by the elastomer volume, V, gives the average power dissipation density:

$$\left|\frac{W_{diss}}{V}\right| = \frac{ng_oG_0}{2L^2\omega_o^2}\left|\frac{1}{t}\int_0^t\left[f(t') - \frac{1}{ng_o}\ddot{x}(t')\right]\dot{x}(t')\,dt'\right|$$

Figure 7:
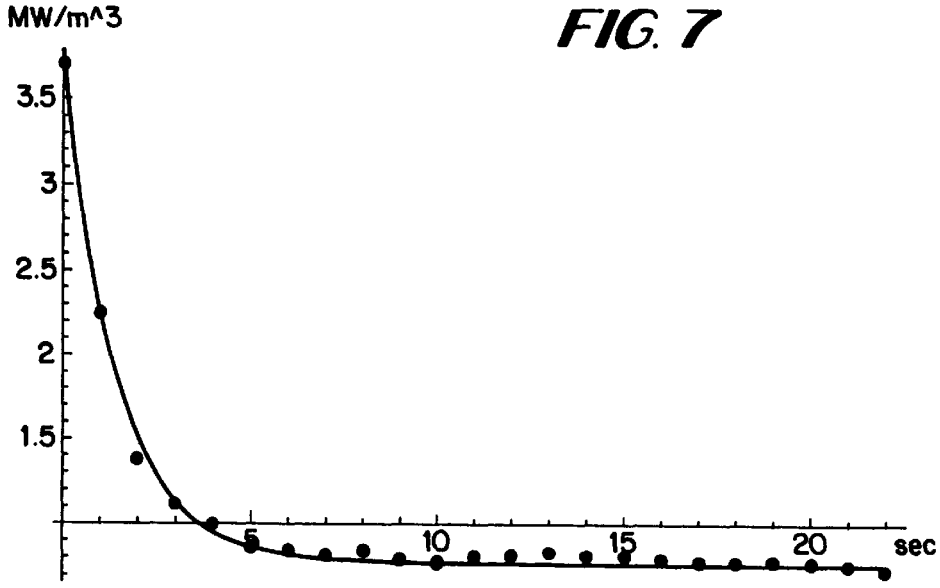
FIG. 7 illustrates time averaged power density dissipated in a typical elastomer damper.

This function is shown in FIG. 7 as the dots, with the solid curve representing the analytical fit of the points:

$$\left|\frac{W_{diss}}{V}\right| = \dot{P}_V[1 + C_oe^{-\gamma t}]$$

The constants in this equation depend on the details of the system response in terms of acceleration and velocity, averaged over time. The front-end "spike" is due to the transient response of the system, and the flat portion is due to the forced response. Evidently, the power dissipated is a function of the various system parameters and the excitation spectrum. It is unique to each damped structural system and acts as the driving function for the elastomer temperature increase.

Figure 8:
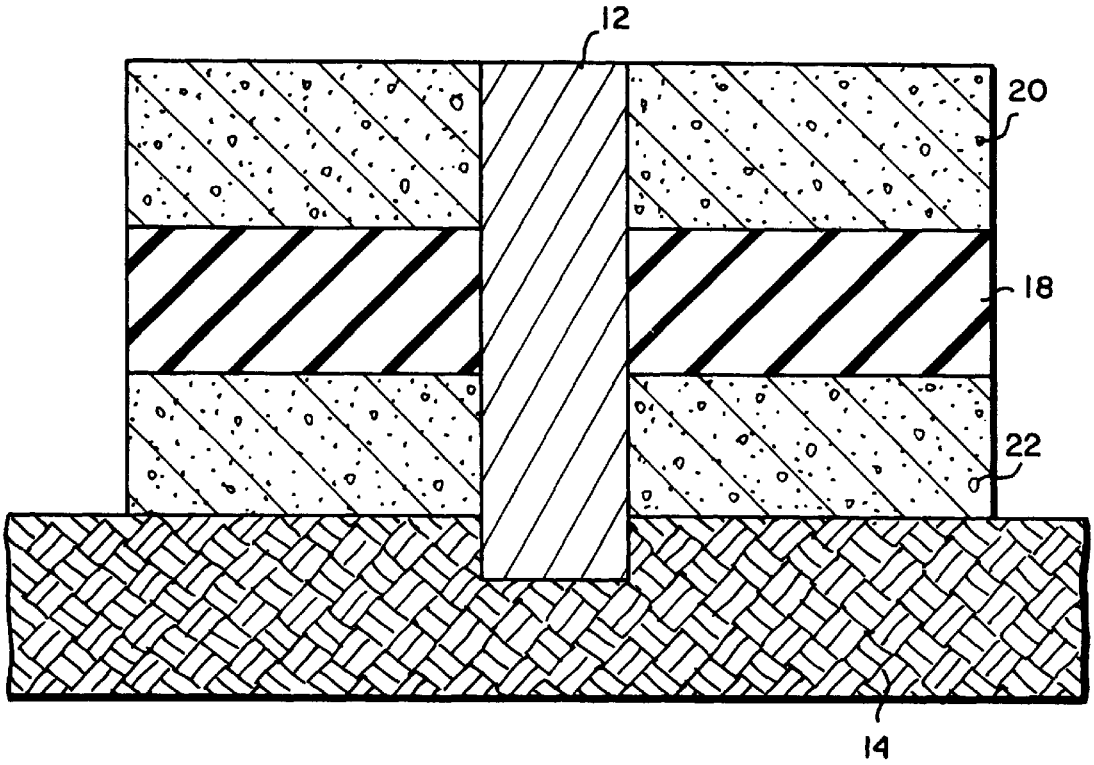
FIG. 8 illustrates a typical unit cell in a damped support structure in accordance with one embodiment of this invention.

To estimate the temperature rise in the elastomer, it is necessary to specify a geometry and the heat sink(s) available. A conservative estimate can be obtained by referring to FIG. 1 and assuming the several support piers act as distributed heat sinks, typified by a plurality of circular "unit cells", each configured as shown in FIG. 8. Each "cell" is circular, when viewed in plan. Thus, FIG. 8 shows one of the piers 12 in relation to the concrete pads 20, 22 and the interposed elastomer layer 18. In a typical seismic event, the structure will vibrate laterally, with one degree of freedom allowed by the sandwich arrangement of concrete pads 20, 22 on either side of the elastomer 18. The concrete pads 20, 22 are assumed to conduct negligible heat, compared to the steel piers 12, which are cylindrical columns in good thermal contact with the elastomer pad 18. During the seismic event, the pier 12 will stiffen and will conduct heat from the elastomer into the heat sink, i.e., the bedrock 14. Each cell possesses a temperature distribution, T(r,t), in space and time, which is described by the thermal diffusion equation:

$$\alpha^2\left[\frac{\partial^2}{\partial r^2} + \frac{1}{r}\frac{\partial}{\partial r}\right]T - \frac{\partial T}{\partial t} = -\frac{\dot{P}_V}{\kappa}[1 + C_oe^{-\gamma t}];\ \alpha^2 = \frac{\kappa}{\rho c_p}$$

Figure 9:
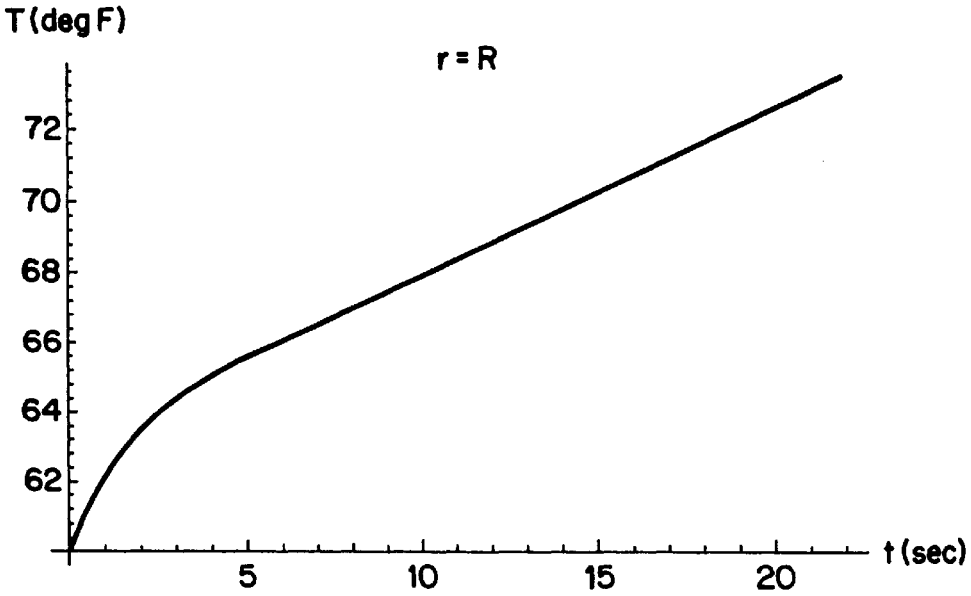
FIG. 9 illustrates the temperature rise at the outer periphery of a damped support structure unit cell in accordance with the invention.

Here, $\alpha^2$ is the diffusivity, $\rho$ the density, and $c_p$ the specific heat of the elastomer. The temperature at the pier surface remains at the heat sink temperature, $T_0$, throughout the transient. The maximum temperature rise occurs at the outer radius, R, of each unit cell. The maximum temperature rise, assuming $T_0$=60° F. (16° C.), is shown in FIG. 9 and is calculated from the following formula:

$$\frac{T(R,t)-T_0}{T_{\max}} = \left[y_o^2 + 2\ln\left(\frac{1}{y_o}\right) - 1\right]\{1 - e^{-\gamma t}\} + \sum_{i=1}^{\infty} a_i U_0(\beta_i y)\left\{e^{-\frac{\beta_i^2 \alpha_t^2}{R^2}} - e^{-\gamma t}\right\}$$

$$y_o = \frac{r_{pier}}{R};$$

$$T_{\max} = \left(\frac{R^2 \dot{P}_V}{4\kappa}\right)$$

The cylinder functions of zero-order and first-order, $U_0$, $U_1$, are defined in terms of Bessel functions of the first and second kind as:

$$U_0(\beta_i y) = J_0(\beta_i y)Y_0(\beta_i y_o) - J_0(\beta_i y_o)Y_0(\beta_i y)$$

$$U_1(\beta_i) = -J_1(\beta_i y)Y_0(\beta_i y_o) + J_0(\beta_i y_o)Y_1(\beta_i y)$$

where the eigenvalues, βi, are the solutions of:

$$U_1(\beta_i) = 0$$

The modal coefficients are given by:

$$a_i = \frac{8 y_o U_1(\beta_i y_o)}{U_0^2(\beta_i) - (y_o U_1(\beta_i y_o))^2}\left[-\frac{C_o}{(\beta_o^2 - \beta_i^2)\beta_i} + \frac{1}{\beta_i^3}\right];$$

$$\beta_o^2 = \frac{\gamma R^2}{\alpha^2}$$

Evidently, for the example calculated in FIG. 9, the nominal temperature rise is tolerable and would not seriously degrade the elastomer properties. It is possible, therefore, to judiciously design the elastomeric isolation structure in such a way as to limit seismic response without excessive heating.

Figure 10:
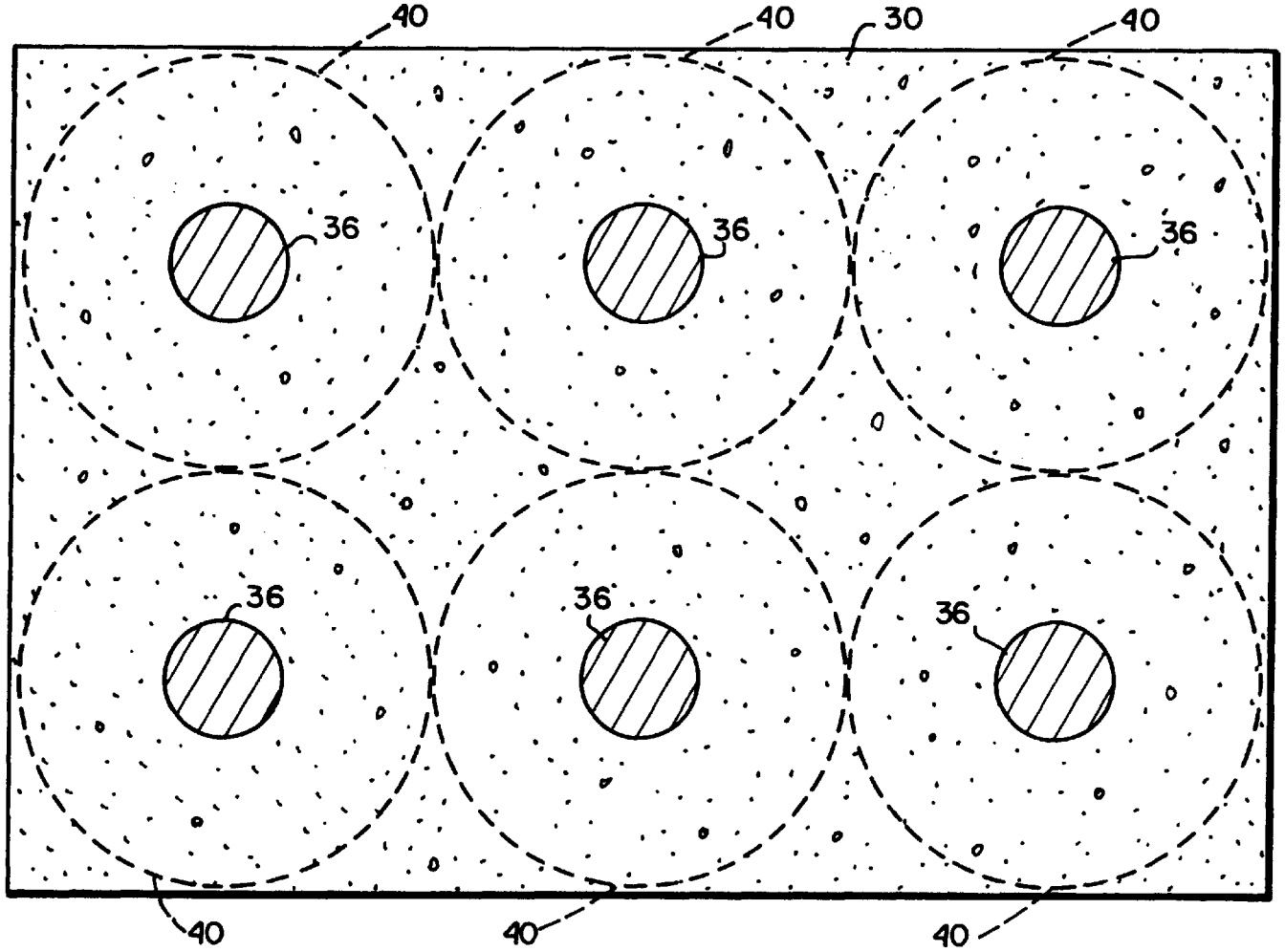
FIG. 10 illustrates a damped support structure in accordance with another embodiment of the invention.
Figure 11:
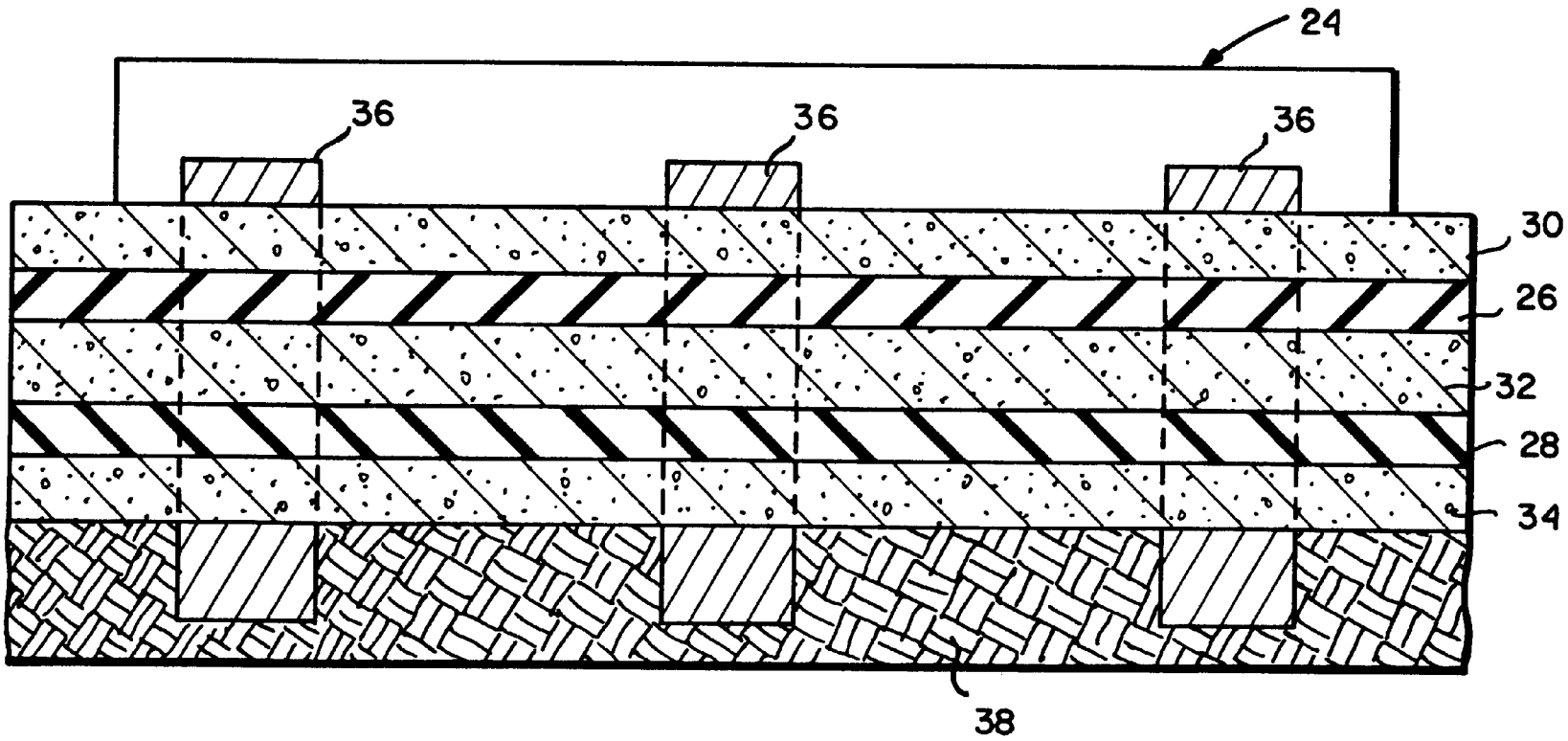
FIG. 11 illustrates a front section of the damped support structure shown in FIG. 10.

Turning now to FIGS. 10 and 11, there is shown a damped support structure 24 utilizing multiple (and different) elastomer layers 26, 28 with alternating concrete reinforcing pads 30, 32 and 34. Support piers 36 extend through the concrete pads and elastomer layers and are anchored in bedrock 38. FIG. 10 illustrates the thermal "unit cells" 40 shown as the dotted circles surrounding each pier 36.

The elastomer pads 26, 28 are chosen to have different frequency properties, consistent with the analysis presented above, so as to cover a wider spectrum of the frequency domain than would be the case with a single elastomer layer. Depending on the seismic spectral complexities expected to be encountered, one or more additional elastomer layers may be required to obtain the necessary spectral response.

Because of the mass of the upper pads 30 and 32, $\omega_o$ is smaller for the lower elastomer pad 28 than for the upper elastomer pad 26. In addition, the pads 26 and 29 are coupled, and the support structure has multiple degrees of freedom that can be analyzed in ways similar to that described above. The damping factors for the elastomers can be specified by analysis to adequately restrain the motion of the superstructure, or building, that is to be protected. Clearly, the size and construction of the support structure depends on the properties of the building that is to be isolated from the ground motion, as well as the seismic spectrum.

In some extreme cases, it may be desirable to "dope" the elastomeric pad(s) with higher conductivity material(s) to increase the diffusivity without changing the shear modulus significantly. This depends on the severity of the thermal transients that must dissipate their energy as heat. In extreme cases, the elastomer properties must be tailored to withstand the shear stress, temperature rise and compressive stress due to static loading and still dissipate significant energy. The methods described herein allow these trade-offs to be assessed and evaluated.

The multiplicity of piers 36, or other support means, not only bears a portion of the vertical loads, but provides some structural rigidity in shear. The support means are also a major heat transfer path to the bedrock 38, or heat sink. The number, size and placement of the support means or piers 36 are a matter of design, specified by the application. The number and dimensions of the support pads 30, 32 and 34 are also application specific and dictated by the design. As noted above, the entire structure is a dynamic system with multiple degrees of freedom, which must be designed to specific criteria. All such designs are included in this disclosure as obvious variants of the basic principles of the invention.

It will be understood that once the properties of the elastomer have been identified for a given application, testing and further analysis will likely result in additional fine tuning of the elastomer properties. In any case, however, by following the methodology described herein, suitable existing elastomers , or new custom manufactured elastomers can be specified for use in accordance with this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of mitigating seismic forces on a structure during a seismic event comprising the steps of:

a) providing a damped support system for the structure comprising a plurality of support piers surrounded by at least two layers of reinforced concrete on either side of at least one layer of an elastomer where said elastomer is engineered to include thermal diffusion and damping properties determined as a function of properties of the structure and as a function of an expected seismic event frequency spectrum; and b) providing for dissipation of heat generated in said elastomer during the seismic event sufficiently to prevent degradation of the damping properties of the elastomer.

2. The method of claim 1 wherein at least two layers of elastomer are utilized, said two layers of elastomer having different thermal diffusion and damping properties.

3. The method of claim 1 wherein step b) is carried out by constructing said plurality of piers of heat conductive material to thus provide a heat sink for heat generated in said elastomer during said seismic event.

4. The method of claim 1 and including the step of enhancing thermal conductivity of the elastomer by addition of higher conductivity materials.

5. A method of mitigating seismic forces on a structure during a seismic event comprising the steps of:

a) supporting the structure with a plurality of piers; and b) surrounding said plurality of piers with a seismic damping system including at least one elastomer engineered to include thermal diffusion and damping properties specified as a function of a predicted seismic frequency spectrum; and c) providing for dissipation of heat generated in said elastomer during the seismic event sufficiently to prevent degradation of the damping properties of the elastomer.

6. The method of claim 5 wherein step b) includes surrounding said plurality of piers with an alternating arrangement of concrete reinforcing pads and elastomer pads which includes at least two elastomer pads and three concrete reinforcing pads.

7. The method of claim 6 wherein said at least two elastomer pads have different damping properties.

8. The method of claim 7 wherein said at least two elastomer pads have different thermal diffusion properties.

9. A support system for a structure comprising:

a plurality of support piers in a predetermined array, adapted to support the structure; and at least two rigid reinforcing pads sandwiched about an elastomer layer, said plurality of support piers extending through said reinforcing pads and said elastomer layer, and wherein said elastomer layer has damping and thermal diffusion properties selected as a function of characteristics of the structure and as a function of a seismic frequency spectrum expected to be encountered during a seismic event.

10. The support system of claim 9 wherein two elastomer layers are each sandwiched by rigid reinforcing pads.

11. The support system of claim 9 wherein said support piers are constructed of heat conductive material adapted to transfer heat energy from said elastomer layer during a seismic event.

12. The support system of claim 10 wherein said two elastomer layers have different damping properties.

13. A support system for a structure comprising:

a plurality of support piers in a predetermined array, supporting a structure; and at least two rigid reinforcing pads sandwiched about an elastomer layer, said elastomer having damping and thermal diffusion properties selected as a function of a seismic frequency spectrum expected to be encountered during a seismic event, said plurality of support piers extending through said reinforcing pads and said elastomer layer, and wherein said plurality of support piers are arranged as a function of thermal properties of both said support piers and said elastomer layer to thereby provide a heat sink such that the damping properties of the elastomer are not significantly degraded by heat generated during the seismic event.

* * * * *

UNITED STATES PATENT AND TRADEMARK OFFICE

CERTIFICATE OF CORRECTION

PATENT NO. : 6,192,649 B1
DATED : February 27, 2001
INVENTOR(S) : Karim-Panahi et al.

It is certified that error appears in the above-identified patent and that said Letters Patent is hereby corrected as shown below:

Column 2,
Line 64, delete "dumped" and insert -- damped --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*